US010562728B2

(12) United States Patent
Ota et al.

(10) Patent No.: US 10,562,728 B2
(45) Date of Patent: Feb. 18, 2020

(54) RECORDING APPARATUS

(71) Applicant: SEIKO EPSON CORPORATION, Tokyo (JP)

(72) Inventors: Hidenobu Ota, Hara (JP); Takao Yamamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 130 days.

(21) Appl. No.: 15/508,858

(22) PCT Filed: Sep. 4, 2015

(86) PCT No.: PCT/JP2015/004506

§ 371 (c)(1),
(2) Date: Mar. 3, 2017

(87) PCT Pub. No.: WO2016/035347

PCT Pub. Date: Mar. 10, 2016

(65) Prior Publication Data

US 2017/0253452 A1 Sep. 7, 2017

(30) Foreign Application Priority Data

Sep. 5, 2014 (JP) ..... 2014-180932
Sep. 5, 2014 (JP) ..... 2014-180933
(Continued)

(51) Int. Cl.
*B65H 23/188* (2006.01)
*B41J 15/00* (2006.01)
(Continued)

(52) U.S. Cl.
CPC ..... *B65H 23/1888* (2013.01); *B41J 15/005* (2013.01); *B41J 15/04* (2013.01);
(Continued)

(58) Field of Classification Search
CPC ..... B65H 23/1888; B65H 23/188; B65H 23/192; B65H 23/182; B65H 23/185;
(Continued)

(56) References Cited

U.S. PATENT DOCUMENTS 4,805,501 A * 2/1989 Nuttin ..... B26D 1/626 83/300
6,964,392 B1 * 11/2005 Matsunaga ..... B65H 23/188 226/195
(Continued)

FOREIGN PATENT DOCUMENTS

CN 102815557 A 12/2012
JP 2000-327190 11/2000
(Continued)

OTHER PUBLICATIONS

Shinjo, Rayoya; JP2008-302536A—Translation; Paper Carrying Device and Image Forming Device; Espacenet; Dec. 18, 2008 (Year: 2008).*
(Continued)

*Primary Examiner* — Michael R Mansen
*Assistant Examiner* — Raveen J Dias
(74) *Attorney, Agent, or Firm* — Workman Nydegger

(57) ABSTRACT

Meandering of a medium at a time of transporting is reduced. A recording apparatus which transports medium and performs recording on the medium is provided. The apparatus includes a recording unit, a medium clamping unit which is provided on a side further upstream than the recording unit in a transport direction, and clamps the medium therebetween, and a medium support unit which is provided on the side further upstream than the medium clamping unit in the transport direction, and supports the medium. The medium is slackened between the medium clamping unit and the medium support unit.

6 Claims, 11 Drawing Sheets

(30) Foreign Application Priority Data

Sep. 5, 2014 (JP) ..... 2014-180934
Jun. 16, 2015 (JP) ..... 2015-120867

(51) Int. Cl.
*B65H 23/192* (2006.01)
*B41J 15/04* (2006.01)
*B65H 23/182* (2006.01)
*B41J 11/00* (2006.01)
*B65H 20/00* (2006.01)

(52) U.S. Cl.
CPC ..... *B41J 15/046* (2013.01); *B65H 23/182* (2013.01); *B65H 23/188* (2013.01); *B65H 23/192* (2013.01); *B41J 11/00* (2013.01); *B65H 20/00* (2013.01); *B65H 2301/512125* (2013.01); *B65H 2403/51* (2013.01); *B65H 2403/514* (2013.01); *B65H 2404/143* (2013.01); *B65H 2404/1441* (2013.01); *B65H 2511/224* (2013.01); *B65H 2801/12* (2013.01)

(58) Field of Classification Search
CPC .... B65H 2301/512; B65H 2301/51212; B65H 2301/512125; B65H 23/042; B65H 23/18; B65H 57/006; B65H 57/02; B41J 15/055; B41J 15/16
USPC ..... 242/418, 418.1
See application file for complete search history.

(56) References Cited

U.S. PATENT DOCUMENTS 8,708,445 B2 * 4/2014 Hatada ..... B41J 11/001 347/101
9,539,831 B2 * 1/2017 Tanami ..... B41J 11/42
2005/0191109 A1 * 9/2005 Takahashi ..... B41J 3/4075 400/619
2009/0261140 A1 * 10/2009 Kase ..... B41J 15/005 226/50
2009/0297244 A1 * 12/2009 Hatada ..... B41J 11/42 400/582
2010/0239349 A1 * 9/2010 Sakurai ..... B41J 11/001 400/642
2011/0210500 A1 * 9/2011 Sato ..... B41J 15/005 271/228
2011/0293347 A1 * 12/2011 Sekino ..... B41J 13/0009 400/582
2012/0087707 A1 4/2012 Igarashi
2012/0200628 A1 8/2012 Igarashi
2012/0206550 A1 8/2012 Takeuchi et al.
2012/0305621 A1 * 12/2012 Horaguchi ..... B41J 11/42 226/4
2012/0312855 A1 12/2012 Horaguchi
2013/0026283 A1 * 1/2013 Kikuchi ..... B65H 20/005 242/563
2013/0099046 A1 * 4/2013 Izumi ..... B65H 20/32 242/417
2013/0100223 A1 * 4/2013 Sato ..... G03G 15/652 347/104
2013/0127943 A1 * 5/2013 Abe ..... B41J 13/0009 347/16
2014/0034718 A1 * 2/2014 Campanini ..... B41J 11/70 235/3
2014/0035984 A1 * 2/2014 Mills, III ..... B41J 13/025 347/16
2014/0152733 A1 * 6/2014 Sano ..... H02P 7/29 347/16

FOREIGN PATENT DOCUMENTS

JP 2002-080153 A 3/2002
JP 3778264 3/2006
JP 3877592 11/2006
JP 2008-302536 12/2008
JP 4937001 3/2012
JP 2012-082024 4/2012
JP 2012-218936 11/2012

OTHER PUBLICATIONS

International Search Report dated Nov. 30, 2015 for PCT/JP2015/004506.

* cited by examiner

[Fig. 1]
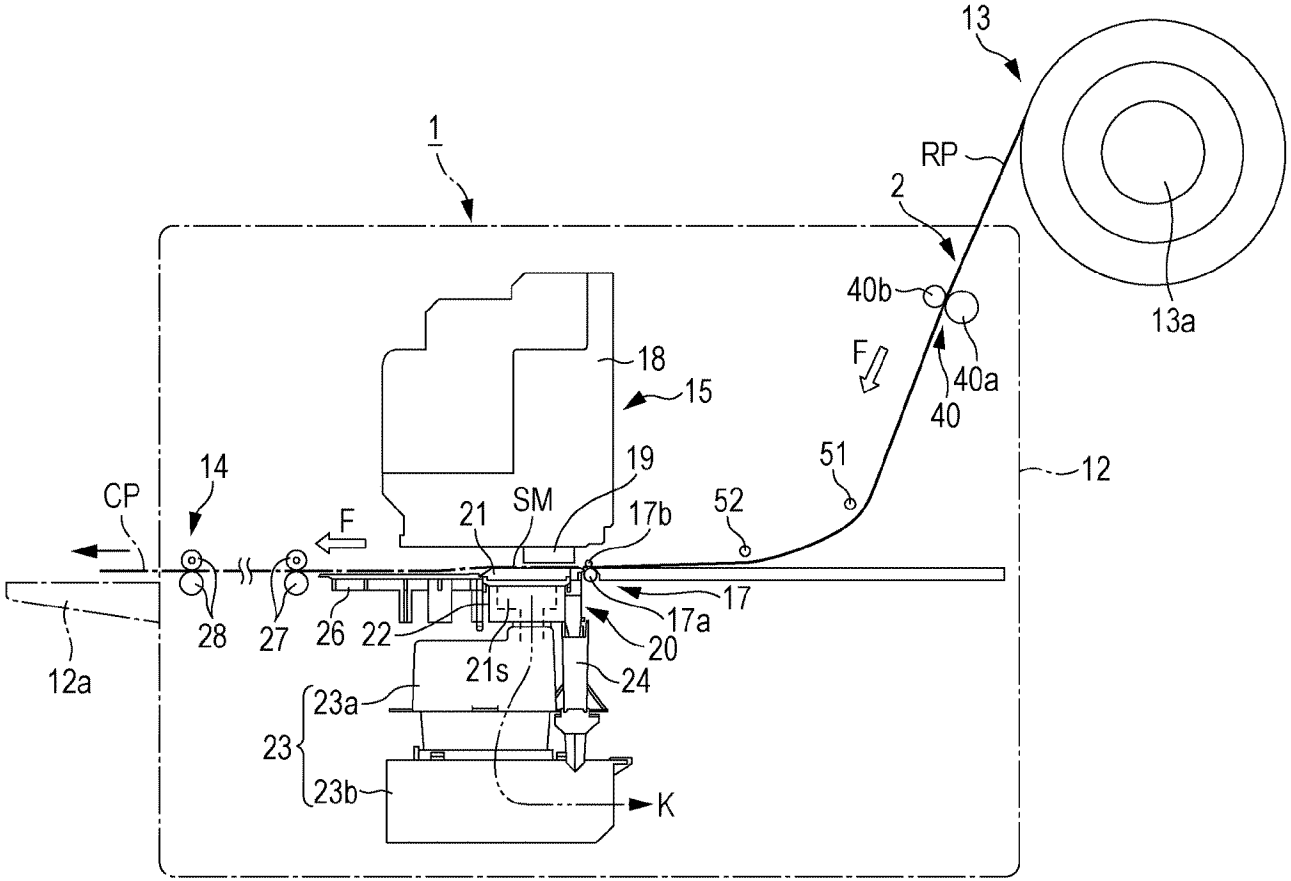

[Fig. 2]
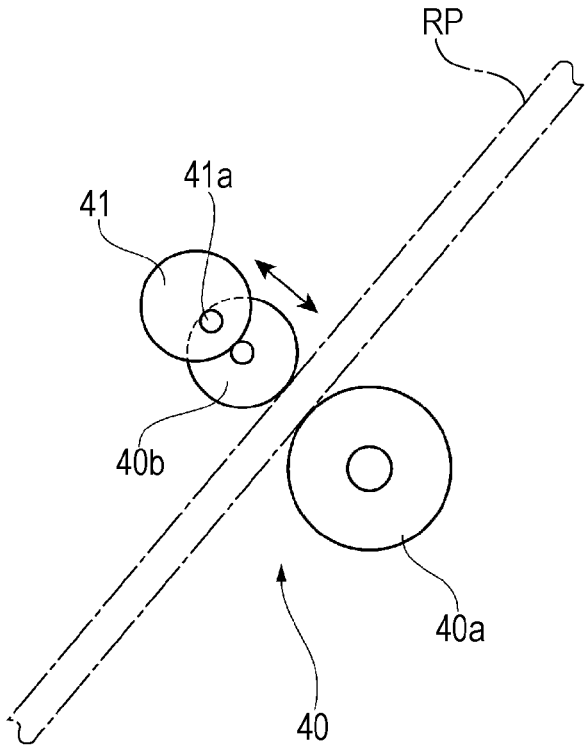

[Fig. 3]
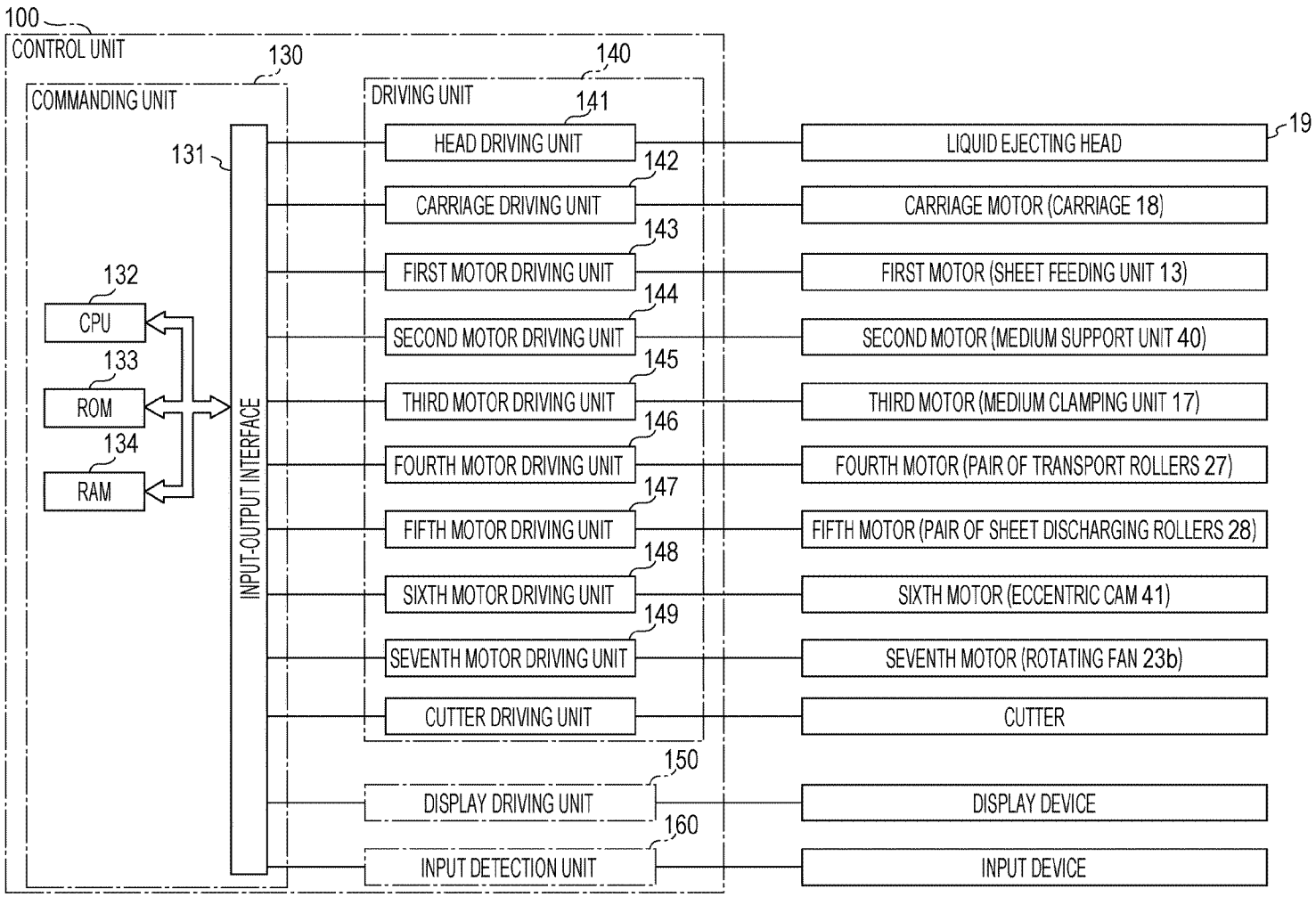

[Fig. 4]
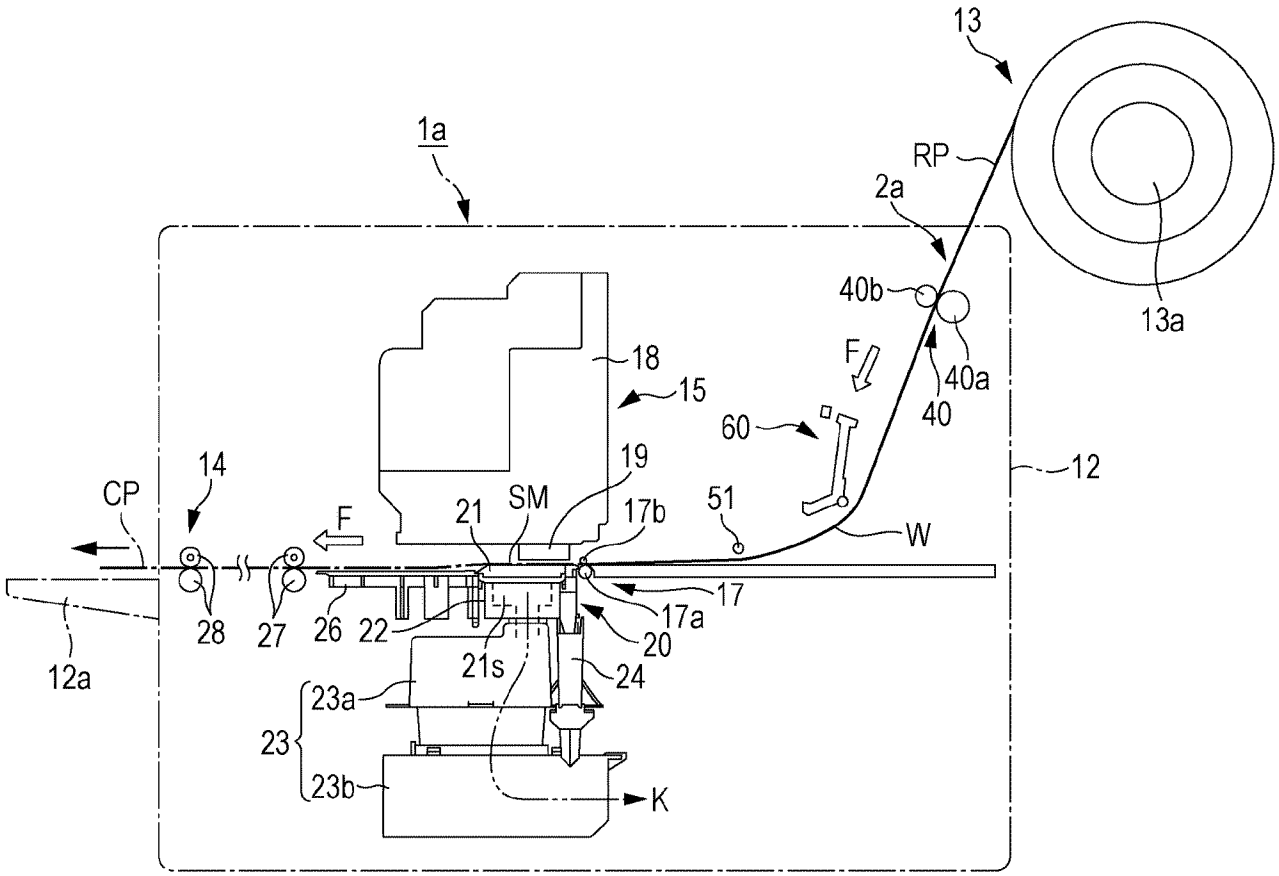

[Fig. 5A]
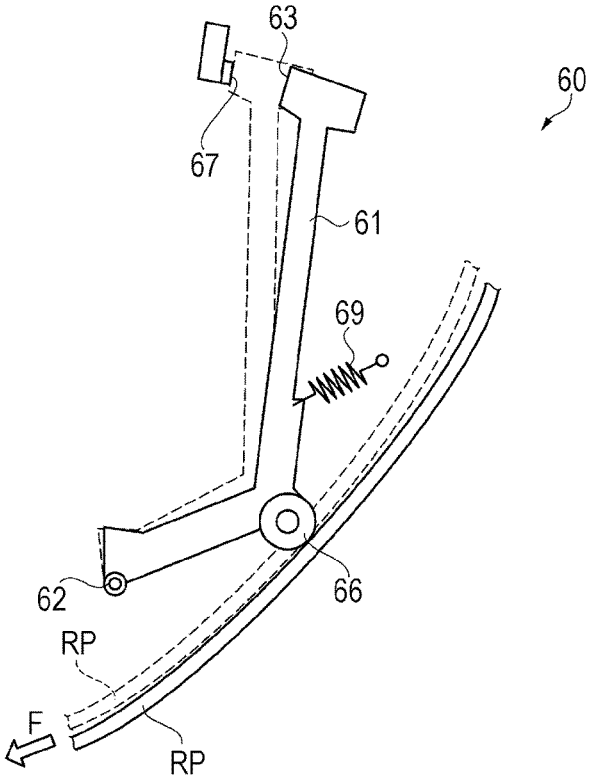
[Fig. 5B]
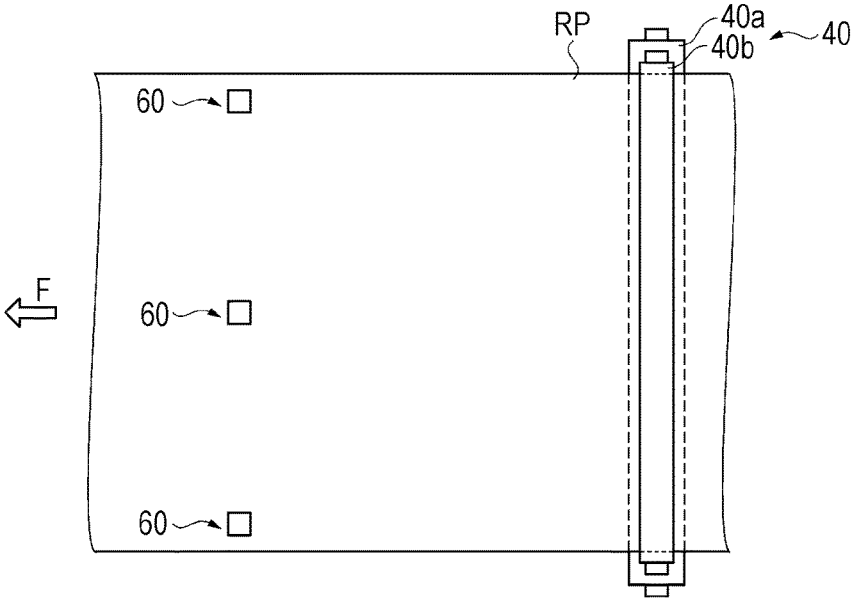

[Fig. 6]
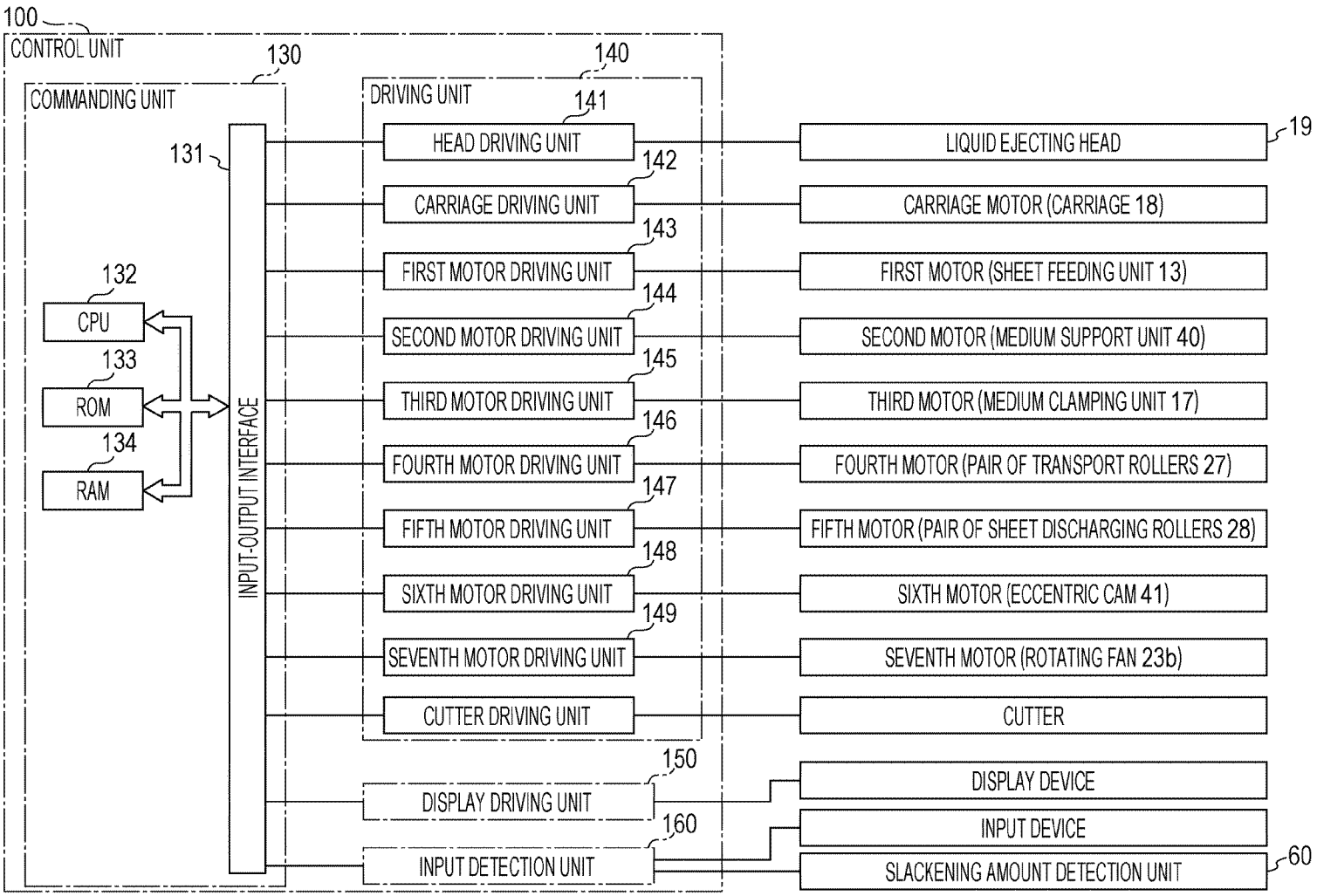

[Fig. 7]
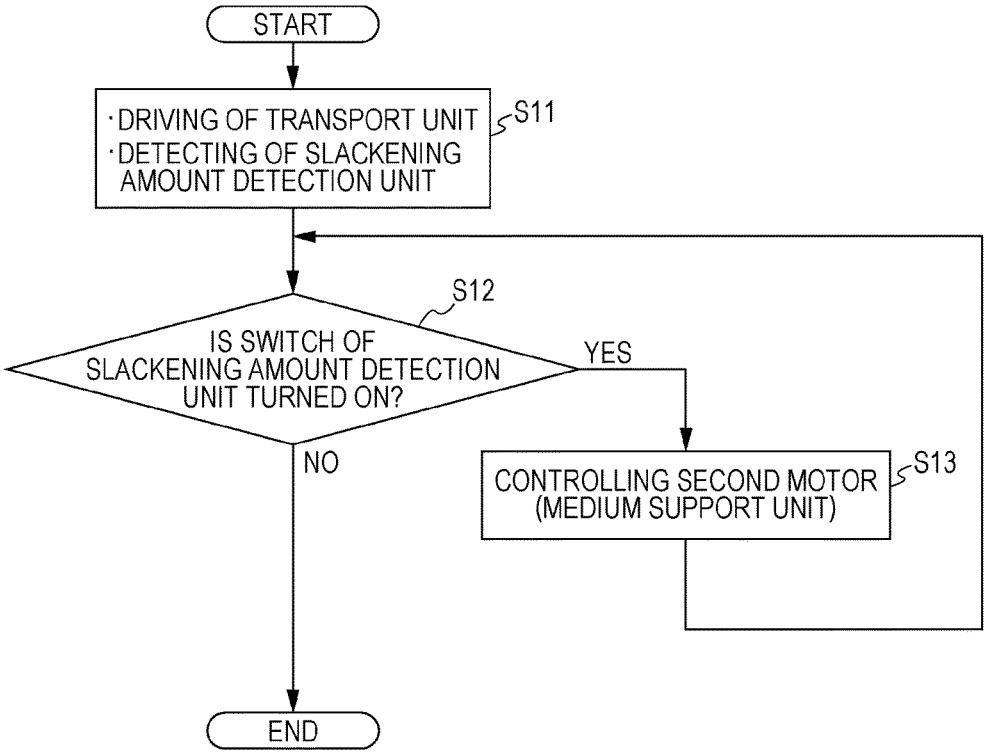

[Fig. 8]
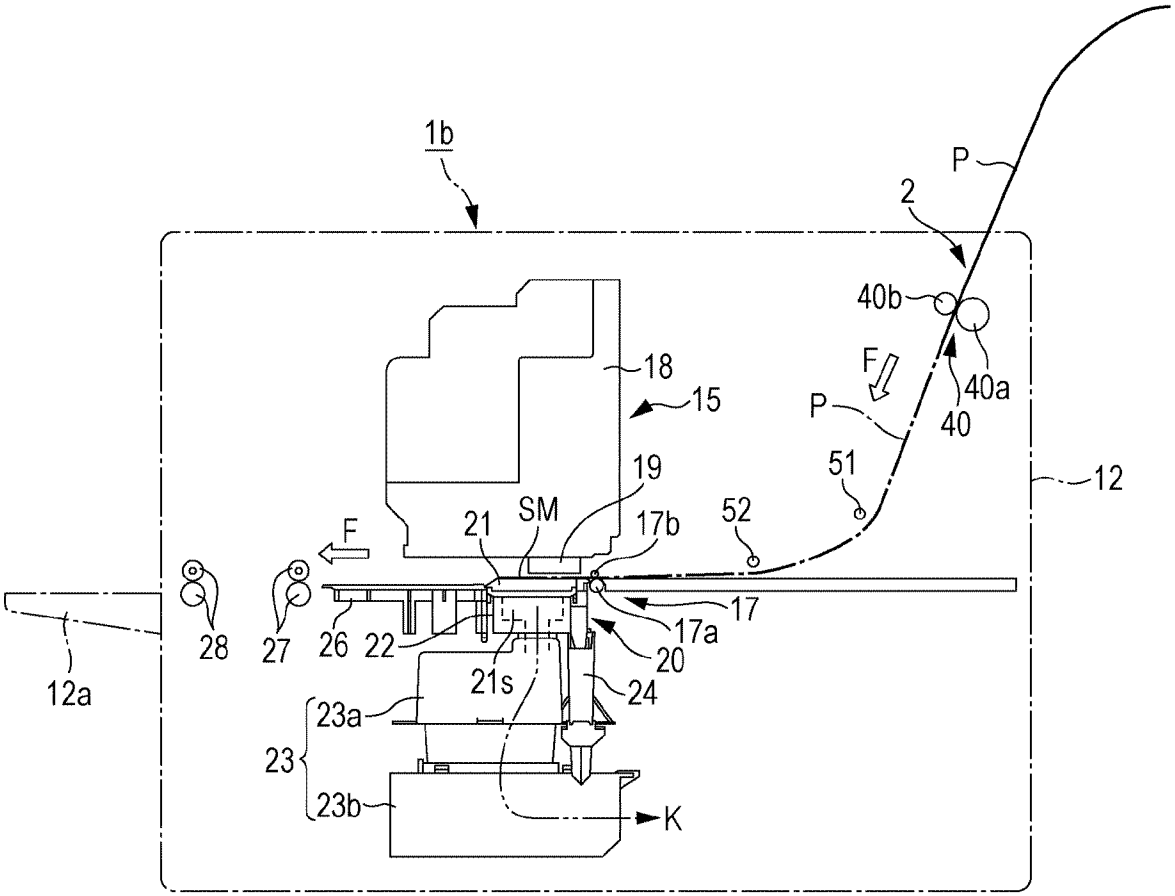

[Fig. 9]
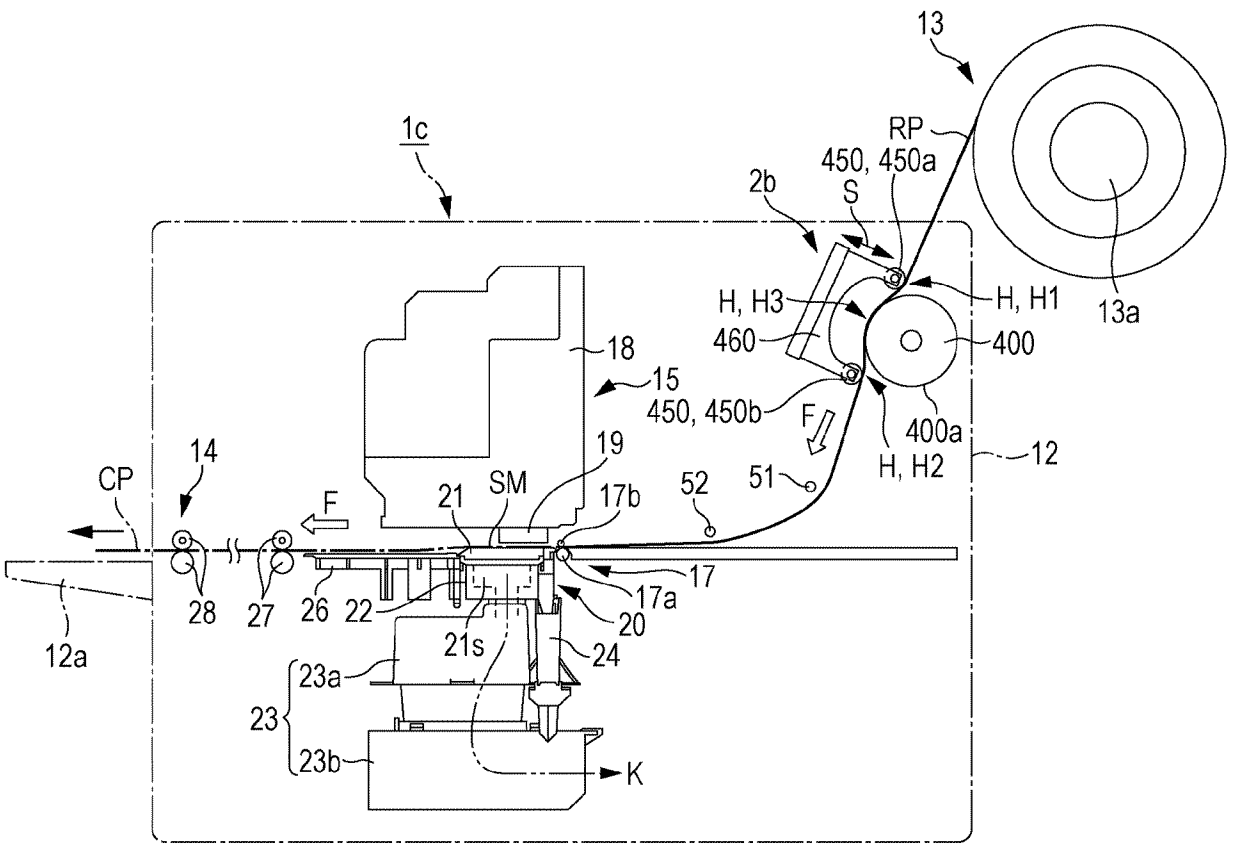

[Fig. 10]
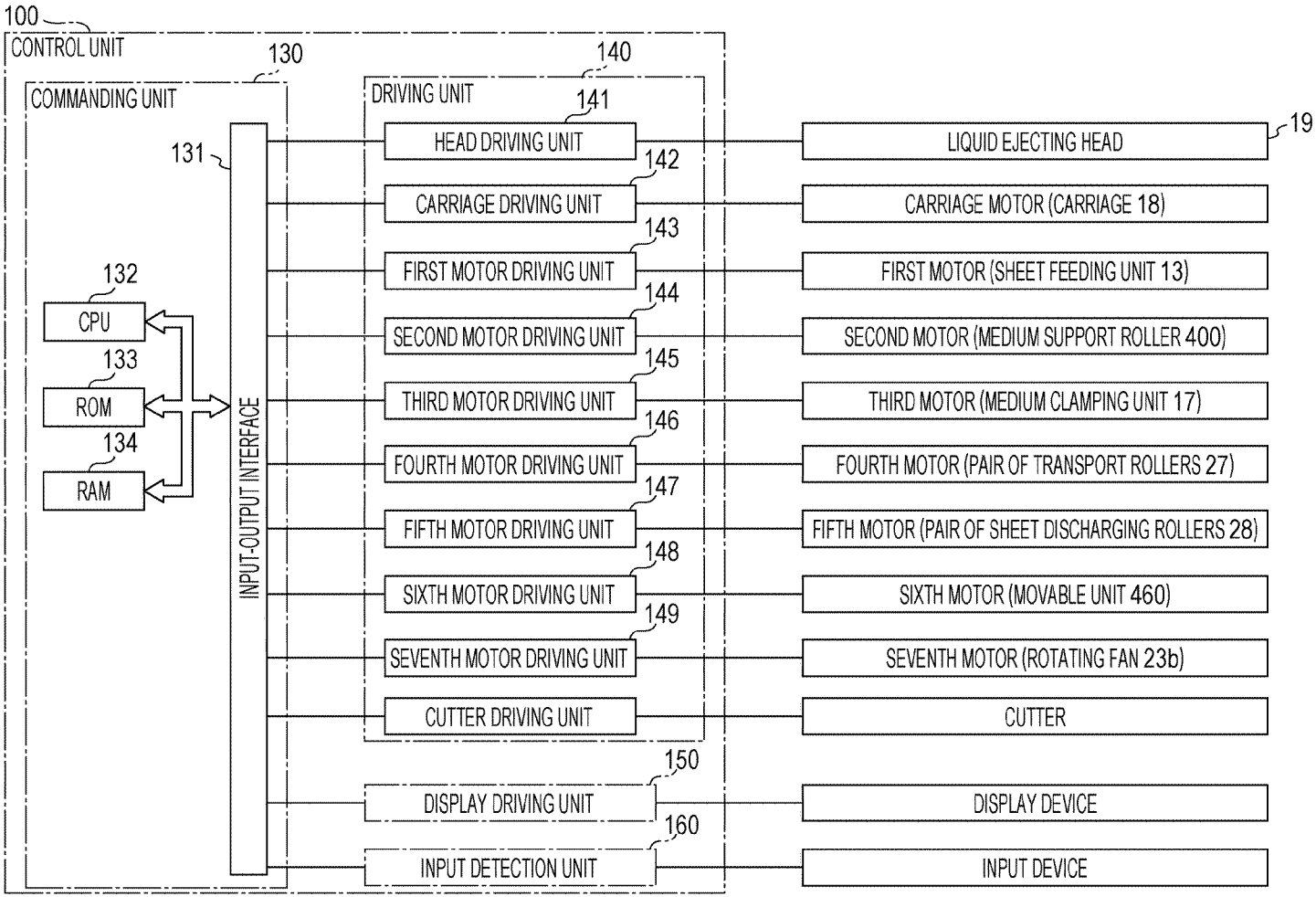

[Fig. 11]
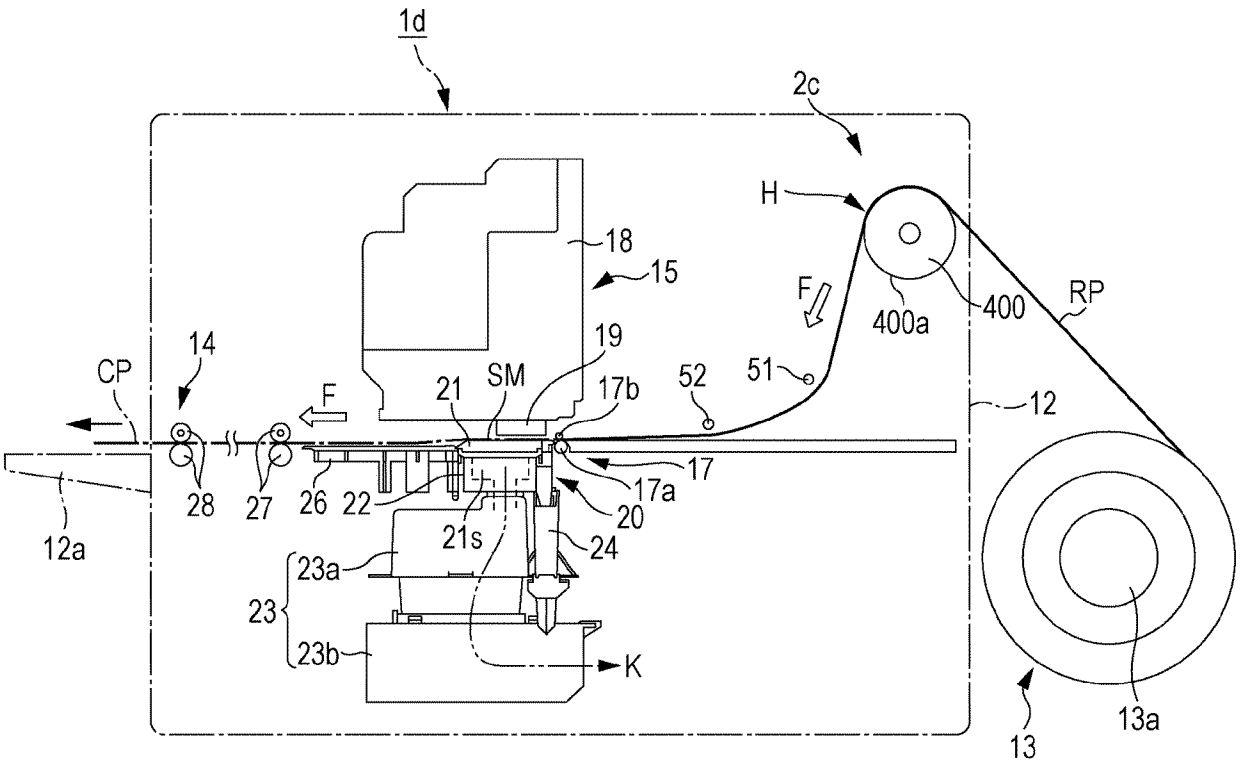

RECORDING APPARATUS

The entire disclosure of Japanese Patent Application No. 2014-180932, filed Sep. 5, 2014, No. 2014-180933, filed Sep. 5, 2014, No. 2014-180934, filed Sep. 5, 2014 and No. 2015-120867, filed Jun. 16, 2015 are expressly incorporated by reference herein.

TECHNICAL FIELD

The present invention relates to a recording apparatus.

BACKGROUND ART

In the related art, a printer which includes, for example, a roll body driving mechanism which transports a medium in a transport direction by rotating a roll body around which the medium is wound in a roll shape, a first transport mechanism which is provided on the side further downstream than the roll body in the transport direction, and transports the medium, and a second transport mechanism which is provided between the roll body and the first transport mechanism, and transports the medium, and in which the medium is transported in a state of maintaining constant tension between the first transport mechanism and the second transport mechanism is known (for example, refer to PTL 1).

CITATION LIST

Patent Literature

PTL 1: JP-A-2012-82024

SUMMARY OF INVENTION

Technical Problem

However, in the printer, error in a transport amount occurs due to an eccentric rotation, or the like, of a second transport mechanism, or a difference in a transport amount of the second transport mechanism occurs between one end side and the other end side in a width direction of a medium, and a printing head side is influenced by a fluctuation in a transport amount through a first transport mechanism, and as a result, there is a problem in that printing quality deteriorates.

Solution to Problem

The present invention has been made in order to solve at least a part of the above described problem, and can be executed as the following embodiments or application examples.

APPLICATION EXAMPLE 1

A recording apparatus according to the application example is a recording apparatus which transports a medium, and performs recording with respect to the transported medium, the apparatus including a recording unit, a medium clamping unit which is provided on the side further upstream than the recording unit in a transport direction, and clamps the medium therebetween, and a medium support unit which is provided on the side further upstream than the medium clamping unit in the transport direction, and supports the medium, in which the medium is slackened between the medium clamping unit and the medium support unit.

According to the configuration, even when a difference in a transport amount occurs in the width direction of a medium which is pulled out from a roll body when transporting the medium, the medium is supported by the medium support unit before being transported to the medium clamping unit. In addition, it is configured so that the medium is slackened between the medium clamping unit and the medium support unit. That is, since tension is not applied to the medium between the medium clamping unit and the medium support unit, a difference in a transport amount of the medium in the width direction is easily reduced.

APPLICATION EXAMPLE 2

In the recording apparatus according to the application example, the medium may be pulled out from a roll body which is wound up in a roll shape, and a transport amount of the medium may be adjusted so that a predetermined tension is applied to the medium between the roll body and the medium support unit.

According to the configuration, it is possible to reduce meandering of the medium which occurs due to eccentricity of the roll body when transporting the medium.

APPLICATION EXAMPLE 3

In the recording apparatus according to the application example, a bending path may be provided between the medium clamping unit and the medium support unit.

According to the configuration, the medium which is pulled out from the roll body is transported to the medium clamping unit through the medium support unit by being bent. In this manner, it is possible to improve the straightness of the medium being transported, since a supported region of the medium using the medium support unit increases.

APPLICATION EXAMPLE 4

In the recording apparatus according to the application example, a slackening amount of the medium between the medium clamping unit and the medium support unit may be adjusted by driving the medium support unit.

According to the configuration, it is possible to easily adjust the slackening amount.

APPLICATION EXAMPLE 5

In the recording apparatus according to the application example, the medium support unit may be configured so as to clamp the medium therebetween, and a clamping force of the medium support unit may be changed.

According to the configuration, it is possible to improve the straightness of a medium being transported without depending on a type of a medium which is transported, by changing a clamping force with respect to the medium which is transported.

BRIEF DESCRIPTION OF DRAWINGS

FIG. 1 is a schematic diagram which illustrates a configuration of a recording apparatus according to a first embodiment.

FIG. 2 is a schematic diagram which illustrates a configuration of a medium support unit according to the first embodiment.

FIG. 3 is a block diagram which illustrates a configuration of a control unit of the recording apparatus according to the first embodiment.

FIG. 4 is a schematic diagram which illustrates a configuration of a recording apparatus according to a second embodiment.

FIG. 5A is a schematic diagram which illustrates a configuration of a slackening amount detection unit according to the second embodiment.

FIG. 5B is a schematic diagram which illustrates a configuration of a slackening amount detection unit according to the second embodiment.

FIG. 6 is a block diagram which illustrates a configuration of a control unit of the recording apparatus according to the second embodiment.

FIG. 7 is a flowchart which illustrates a control method of the recording apparatus according to the second embodiment.

FIG. 8 is a schematic diagram which illustrates a configuration of a recording apparatus according to a modification example 1.

FIG. 9 is a schematic diagram which illustrates a configuration of a recording apparatus according to a modification example 2.

FIG. 10 is a block diagram which illustrates a configuration of a control unit of the recording apparatus according to the modification example 2.

FIG. 11 is a schematic diagram which illustrates a configuration of a recording apparatus according to a modification example 3.

DESCRIPTION OF EMBODIMENTS

Hereinafter, first and second embodiments of the invention will be described with reference to drawings. In addition, in each figure below, the scale of each member, or the like, are denoted using scales different from actual ones in order to make each member, or the like, be a size which is recognizable.

First Embodiment

First, a configuration of a recording apparatus will be described. The recording apparatus is a recording apparatus which transports a medium, performs recording on the transported medium, and includes a recording unit, a medium clamping unit which is provided on the side further upstream than the recording unit in a transport direction, and clamps the medium therebeween, and a medium support unit which is provided on the side further upstream than the medium clamping unit in the transport direction, and supports the medium, in which the medium is slackened between the medium clamping unit and the medium support unit. The recording apparatus is, for example, an ink jet printer. Hereinafter, the recording apparatus will be described in detail.

FIG. 1 is a schematic diagram which illustrates a configuration of the recording apparatus. As illustrated in FIG. 1, a recording apparatus 1 is configured of a main body case 12, a transport unit 2 which transports a medium, and the like. A sheet feeding unit 13 which configures a part of the transport unit 2 is a unit which feeds a medium to the main body case 12. In addition, according to the embodiment, a configuration in which a long sheet-shaped sheet RP as a medium is applied will be described. In addition, in the sheet feeding unit 13 according to the embodiment, a roll body in which the long sheet-shaped sheet RP is wound around a roll axis 13*a* is placed. The roll axis 13*a* has a configuration of being connected to a driving source (motor), and being rotated using driving of the driving source (motor). In addition, the sheet RP is pulled out from the roll body when the roll body is rotated around the roll axis 13*a*, and is supplied to the main body case 12. In addition, the sheet feeding unit 13 may be arranged inside the main body case 12.

A recording unit 15 which forms an image, or the like, by ejecting liquid onto a sheet RP which is supplied, a sheet discharging unit 14 which discharges the sheet RP on which an image, or the like, is formed to a sheet discharging tray 12*a* as a cut sheet CP from a discharging port which is provided in the main body case 12, and the like, are provided in the main body case 12. In addition, the sheet RP is transported to the recording unit 15 using the transport unit 2, and is transported to the sheet discharging unit 14 as a cut sheet CP thereafter.

The recording unit 15 includes a carriage 18 on the higher side (antigravity direction side) of a sheet RP which is transported. The carriage 18 is supported by a guide axis (not illustrated) which is installed in the main body case 12 in a state of extending in approximately the horizontal direction along the width direction of the sheet RP which intersects a transport direction F, and can be moved along the guide axis. A liquid ejecting head 19 is attached to the carriage 18 on a lower face side which faces the sheet RP which is transported. The liquid ejecting head 19 is provided with a plurality of nozzles (not illustrated) which eject ink as an example of liquid, and performs a reciprocating movement in a direction (main scanning direction) which goes along the guide axis along with the carriage 18, when the carriage 18 performs a reciprocating movement along the width direction of the sheet RP while being guided by the guide axis.

In addition, the recording apparatus 1 includes a platen 20 which supports the sheet RP from the lower side (gravity direction side) at a position facing the liquid ejecting head 19 by clamping the sheet RP which is transported therebetween. The platen 20 has an approximately rectangular face in which the main scanning direction is a longitudinal direction, on a top face which confronts the liquid ejecting head 19, and supports the sheet RP by suctioning the sheet on the top face of the platen 20 using negative pressure applied to the platen 20.

That is, the platen 20 includes a support face forming member 21 in an approximately flat-plate shape of which a top face is formed as a medium support face SM supporting the sheet RP which is transported to the transport direction F, and a support unit frame member 22 which is fixed in a connecting manner to the support face forming member 21 on the lower face side opposite to the medium support face SM. In addition, an internal space is formed due to the connected support face forming member 21 and the support unit frame member 22, and the internal space functions as a negative pressure chamber 21*s* to which negative pressure for suctioning the sheet RP on the medium support face SM is applied.

In addition, according to the embodiment, a negative pressure generation unit 23 which is connected to the negative pressure chamber 21*s* so as to communicate therewith, and is formed of a suctioning chamber 23*a* for suctioning air from the negative pressure chamber 21*s*, and a rotating fan 23*b* is provided on the lower side of the platen 20. Accordingly, negative pressure which is generated in the negative pressure generation unit 23 when air (atmosphere) flows as denoted by an arrow K of a two-dotted chain line in the figure, due to a rotation of the rotating fan 23*b*, is applied to the negative pressure chamber 21*s*.

In addition, recording (printing) of an image, or the like, due to attaching of ink to the sheet RP is performed when ink is ejected onto the surface (top face in FIG. 1) of the sheet RP which is supported by the platen 20 by being adsorbed from the liquid ejecting head 19. In addition, when borderless printing is performed in the recording apparatus 1, an ink discharging unit 24 from which the ink ejected to the platen 20 is discharged is provided in the platen 20.

In addition, in the main body case 12, a guiding plate 26 and a pair of transport rollers 27 which guide the sheet RP from the platen 20 side to the sheet discharging unit 14 side are provided on the side further downstream than the platen 20 (support face forming member 21) in the transport direction F. In addition, a pair of sheet discharging rollers 28 which discharges the sheet RP from the sheet discharging port to the sheet discharging tray 12*a* is provided. In addition, a cutter which cuts the sheet RP on which an image is formed to be the cut sheet CP with a predetermined length, a drying unit which dries ink by blowing warm air (drying air) against the printing face of the cut sheet CP, and is provided on the side further downstream than the cutter in the transport direction F, or the like, is provided between the pair of transport rollers 27 and the sheet discharging rollers 28 as necessary. In addition, the drying unit may be arranged on the side further upstream than the cutter in the transport direction F, or may be arranged on the side further upstream than the pair of transport rollers 27 in the transport direction F. In addition, since it is possible to transport the sheet RP to a position of the cutter using the transport unit which is provided on the side further upstream than the cutter in the transport direction F, the pair of transport rollers 27 may not be provided.

Subsequently, a configuration of the transport unit 2 will be described in detail. The transport unit 2 according to the embodiment includes the sheet feeding unit 13, a medium clamping unit 17 which is provided on the side further upstream than the recording unit 15 in the transport direction F, and clamps the sheet RP therebetween, and a medium support unit 40 which is provided on the side further upstream than the medium clamping unit 17 in the transport direction F, and supports the sheet RP.

The medium clamping unit 17 is configured of a sheet sending roller 17*a* and a sheet pressing roller 17*b* which is driven along with a rotation of the sheet sending roller 17*a*. The sheet sending roller 17*a* is configured so as to be connected to a driving source (motor), and be rotated due to driving of the driving source (motor). In this manner, the sheet RP is transported to the recording unit 15 side which is located on the downstream side in the transport direction F while being clamped between the sheet sending roller 17*a* and the sheet pressing roller 17*b*. The sheet sending roller 17*a* has a contact face with a length in a width of the sheet RP or more, and transports the sheet RP by causing the contact face of the sheet sending roller 17*a* to come into contact with the sheet RP in the width direction. The sheet pressing roller 17*b* is configured so as to be urged on the sheet sending roller 17*a* side with an approximately uniform force regardless of a position of the sheet RP in the width direction. In addition, it is possible to arrange a plurality of the sheet pressing rollers 17*b* along the axis direction of the sheet sending roller 17*a*. When arranging the plurality of sheet pressing rollers 17*b*, since it is also possible to weaken a clamping force in each portion by dispersing the clamping force with respect to the sheet RP in each arrangement, by increasing the number of arrangements, or widening a range or a width for arrangement, it is possible to reduce a dent which is generated in the sheet RP when clamped between the sheet sending roller 17*a* and the sheet pressing roller 17*b*.

The medium support unit 40 supports the sheet RP, and according to the embodiment, the medium support unit is configured so as to clamp the sheet RP therebeween. Specifically, as illustrated in FIG. 1, the medium support unit 40 is configured of a first roller 40*a*, and a second roller 40*b* which is driven along with a rotation of the first roller 40*a*. The first roller 40*a* is configured so as to be connected to a driving source (motor), and rotated due to driving of the driving source (motor). In this manner, the sheet RP is transported to the medium clamping unit 17 side which is located on the downstream side in the transport direction F while being clamped between the first roller 40*a* and the second roller 40*b*. The first roller 40*a* has a contact face with a length in the width of the sheet RP or more, and transports the sheet RP by causing the contact face of the first roller 40*a* to come into contact with the sheet RP in the width direction. The second roller 40*b* is configured so as to be urged on the first roller 40*a* side with an approximately uniform force regardless of a position of the sheet RP in the width direction. In addition, a plurality of the second roller 40*b* can be arranged along the axis direction of the first roller 40*a*. When arranging the plurality of second rollers 40*b*, since it is also possible to weaken a clamping force in each portion by dispersing the clamping force with respect to the sheet RP in each arrangement, by increasing the number of arrangements, or widening a range or a width for arrangement, it is possible to reduce a dent which is generated in the sheet RP when clamped between the first roller 40*a* and the second roller 40*b*.

In addition, in the medium support unit 40, it is configured so that the clamping force for clamping the sheet RP can be changed. FIG. 2 is a schematic diagram which illustrates a configuration of the medium support unit. As illustrated in FIG. 2, the medium support unit 40 includes the first roller 40*a* and the second roller 40*b*, and includes an eccentric cam 41 which can change a clamping force of the sheet RP using the first roller 40*a* and the second roller 40*b*. The eccentric cam 41 includes an eccentric axis 41*a* which is deviated from a center of a disc portion, is configured so as to rotate around the eccentric axis 41*a*, and is configured so as to fix the eccentric axis 41*a* to an arbitrary rotating position. An outer peripheral portion of the disc portion of the eccentric cam 41 comes into contact with a rotating axis of the second roller 40*b*. In addition, when the eccentric cam 41 is rotated, the second roller 40*b* can move in a direction which goes toward the first roller 40*a* side due to an eccentric rotation of the disc portion. In this manner, it is possible to arbitrarily change the clamping force for clamping the sheet RP.

In addition, in the transport unit 2, the sheet feeding unit 13 is arranged on the most upstream side in the transport direction F, the medium support unit 40 is arranged on the downstream side of the sheet feeding unit 13 in the transport direction F, and the medium clamping unit 17 is arranged on the downstream side of the medium support unit 40 in the transport direction F. Here, the sheet RP is slackened between the medium clamping unit 17 and the medium support unit 40. In detail, tension is not applied to the sheet RP between the medium clamping unit 17 and the medium support unit 40 by slackening the sheet RP, in a point that the sheet RP is nipped (clamped) between the sheet sending roller 17*a* and the sheet pressing roller 17*b* in the medium clamping unit 17, and a point that the sheet RP is nipped (clamped) between the first roller 40*a* and the second roller 40*b* in the medium support unit 40. In addition, a slackening amount of the sheet RP between the medium clamping unit 17 and the medium support unit 40 is adjusted by driving the medium support unit 40.

Meanwhile, it is configured so that a predetermined tension is applied to the sheet RP between the sheet feeding unit 13 (roll body) and the medium support unit 40. In detail, tension is applied to the sheet RP in a point that the sheet RP is pulled out from the sheet feeding unit 13 (roll body), and a point that the sheet RP is nipped (clamped) between the first roller 40*a* and the second roller 40*b* in the medium support unit 40. In addition, an amount of sending of the sheet RP from the sheet feeding unit 13, and an amount of transporting of the sheet RP at a position of the medium support unit 40, or both the amount of sending of the sheet RP from the sheet feeding unit 13 and the amount of transporting the sheet RP at the position of the medium support unit 40 are configured so as to be adjusted so that a predetermined tension is applied to the sheet RP. Accordingly, the recording apparatus 1 according to the embodiment includes a region in which tension is applied to the sheet RP between the sheet feeding unit 13 (roll body) and the medium support unit 40, and a region in which tension is not applied to the sheet RP between the medium support unit 40 and the medium clamping unit 17 in the transport unit 2. In addition, the sheet RP is transported to the recording unit 15 side in a state of not being applied with tension.

In addition, a bending path is formed between the medium clamping unit 17 and the medium support unit 40. Specifically, relay rollers 51 and 52 which relay a transport of the sheet RP, and are located on the way of a transport path are arranged between the medium clamping unit 17 and the medium support unit 40, and the sheet RP is transported through the vicinity of the relay rollers 51 and 52. In this manner, a transport direction F of the sheet RP which is transported from a higher part to a lower part through the medium support unit 40 from the sheet feeding unit 13 is changed to a transport direction F in a horizontal direction toward the medium clamping unit 17 side from the vicinity of the relay rollers 51 and 52. In addition, the relay rollers 51 and 52 take a role of a regulation unit which regulates so that the sheet RP which is transported does not enter the inside of the bending path more than necessary in the bending path. The sheet RP is slackened in the bending path; however, it is preferable that a slackening amount of the sheet RP is adjusted to the extent of not coming into contact with the relay rollers 51 and 52. In this manner, it is possible to reduce an influence on transporting which occurs when the relay rollers 51 and 52 come into contact with the sheet RP. In addition, since the sheet RP is transported from the higher part to the lower part through the bending path between the medium clamping unit 17 and the medium support unit 40, it is possible to transport the sheet RP in a floated state, and to make the sheet RP not come into contact with a member which is arranged on the lower side of the transport path, or a support unit of the sheet RP in the middle of transporting the sheet RP. For this reason, it is also possible to reduce the influence on transporting which is caused when the sheet RP comes into contact with various members on the side further downstream than the medium support unit 40 in the transport direction F, not only the influence which is caused when tension is applied to the sheet RP on the side further upstream than the medium support unit 40 in the transport direction F.

Subsequently, a configuration of the control unit of the recording apparatus will be described. FIG. 3 is a block diagram which illustrates a configuration of the control unit of the recording apparatus. As illustrated in FIG. 3, a control unit 100 includes a commanding unit 130, a driving unit 140, a display driving unit 150, and an input detection unit 160. The commanding unit 130 is configured of a CPU 132, a ROM 133, a RAM 134, as storage units, and an input-output interface 131, and the CPU 132 processes various signals which are input through the input-output interface 131 based on data of the ROM 133 and the RAM 134, and outputs a control signal to the driving unit 140 through the input-output interface 131. The CPU 132 performs various controls based on a printing program which is stored in the ROM 133, for example.

The driving unit 140 is configured of a head driving unit 141, a carriage driving unit 142, a first motor driving unit 143, a second motor driving unit 144, a third motor driving unit 145, a fourth motor driving unit 146, a fifth motor driving unit 147, a sixth motor driving unit 148, the seventh motor driving unit 149, and the like. In addition, the head driving unit 141 controls the liquid ejecting head 19 based on a control signal of the commanding unit 130. In addition, the carriage driving unit 142 controls a carriage motor, and a movement of the carriage 18. In addition, the first motor driving unit 143 controls driving of a first motor which is connected to the roll axis 13*a* of the sheet feeding unit 13. The second motor driving unit 144 controls driving of a second motor which is connected to the first roller 40*a* of the medium support unit 40. The third motor driving unit 145 controls driving of a third motor which is connected to the sheet sending roller 17*a* of the medium clamping unit 17. The fourth motor driving unit 146 controls driving of a fourth motor which is connected to the pair of transport rollers 27. The fifth motor driving unit 147 controls driving of a fifth motor which is connected to the pair of sheet discharging rollers 28. The sixth motor driving unit 148 controls driving of a sixth motor which is connected to the eccentric cam 41. In addition, the seventh motor driving unit 149 controls driving of a seventh motor which is connected to the rotating fan 23*b*.

In addition, the display driving unit 150 is connected to the commanding unit 130 of the control unit 100 through the input-output interface 131. In addition, a display device (for example, monitor) is connected to the display driving unit 150. In addition, the input detection unit 160 is connected to the commanding unit 130 of the control unit 100 through the input-output interface 131. In addition, an input unit such as a mouse or a keyboard is connected to the input detection unit 160. In addition, by configuring the control unit 100 in this manner, it is possible to control various units. For example, it is possible to apply a predetermined tension to the sheet RP between the sheet feeding unit 13 (roll body) and the medium support unit 40 by performing driving controls of the first motor which is connected to the sheet feeding unit 13, and the second motor which is connected to the medium support unit 40. In addition, it is possible to adjust a slackening amount of the sheet RP between the medium clamping unit 17 and the medium support unit 40 by performing a driving control of the second motor which is connected to the first roller 40*a* of the medium support unit 40. In addition, it is possible to arbitrarily change a clamping force with respect to the sheet RP using the first roller 40*a* and the second roller 40*b* of the medium support unit 40 by performing a driving control of the sixth motor which is connected to the eccentric cam 41. In addition, it is possible to perform a control so that a sending amount of the sheet RP which is transported in the transport direction F using the first roller 40*a* of the medium support unit 40 is larger than a sending amount of the sheet RP which is transported in the transport direction F using the sheet sending roller 17*a* of the medium clamping unit 17, by performing driving controls of the second and third motors.

As described above, according to the embodiment, it is possible to obtain the following effects.

Even when there is a difference in a transport amount of the sheet RP in the width direction which is pulled out from the roll body of the sheet feeding unit 13 when transporting the sheet RP in the transport direction F, the sheet RP is supported by the medium support unit 40 before being transported to the medium clamping unit 17. Since tension is applied to the sheet RP between the roll body of the sheet feeding unit 13 and the medium support unit 40, error (meandering) in the transport amount is reduced. In addition, since it is configured so that the sheet RP is slackened between the medium support unit 40 and the medium clamping unit 17, and tension is not applied to the sheet RP, even when the first roller 40*a* of the medium support unit 40 performs an eccentric rotation, or there is a difference in a transport amount of the medium of the medium support unit 40 between one end side and the other end side of the sheet RP in the width direction, an influence caused by a fluctuation in a transport amount of the medium does not become strong on the side further upstream than the medium support unit 40 in the transport direction F. That is, a fluctuation in a transport amount when the sheet RP is transported, or a difference in a transport amount of the sheet RP in the width direction is easily reduced. Accordingly, the fluctuation in a transport amount of the sheet RP or meandering of the sheet RP is avoided before the sheet RP reaches the recording unit 15, and it is possible to perform high quality recording on the sheet RP in the recording unit 15.

Second Embodiment

Subsequently, a second embodiment will be described.

First, a configuration of the recording apparatus will be described. The recording apparatus according to the embodiment is a recording apparatus which transports a medium which is pulled out from a roll body around which the medium is wound in a roll shape, and performs recording, and includes a recording unit, a medium clamping unit which is provided on the side further upstream than the recording unit in a transport direction, and clamps the medium therebeween, and a medium support unit which is provided on the side further upstream than the medium clamping unit in the transport direction, and supports the medium, and in which a bending path is included between the medium clamping unit and the medium support unit. In addition, in the bending path of the recording apparatus, the medium is slackened, and a slackening amount detection unit which detects a slackening amount of the medium is included. Hereinafter, the recording apparatus will be described in detail.

FIG. 4 is a schematic diagram which illustrates a configuration of the recording apparatus. As illustrated in FIG. 4, a recording apparatus 1*a* is configured of a main body case 12, a transport unit 2*a* which transports the medium, and the like. In addition, since a configuration of the main body case 12, a sheet feeding unit 13 which is arranged in the main body case 12, a recording unit 15, a sheet discharging unit 14, or the like, is the same as that in the first embodiment, descriptions thereof will be omitted.

Subsequently, a configuration of the transport unit 2*a* and the periphery thereof will be described in detail. The transport unit 2*a* according to the embodiment includes the sheet feeding unit 13, a medium clamping unit 17 which is provided on the side further upstream than the recording unit 15 in the transport direction F, and clamps the sheet RP therebetween, and a medium support unit 40 which is provided on the side further upstream than the medium clamping unit 17 in the transport direction F, and supports the sheet RP. In addition, a bending path W is included between the medium clamping unit 17 and the medium support unit 40. Specifically, a relay rollers 51, or the like, which relays a transport of the sheet RP, and is located on the way of a transport path is arranged between the medium clamping unit 17 and the medium support unit 40, and the sheet RP is transported through the vicinity, or the like, of the relay roller 51. In this manner, the transport direction F of the sheet RP which is transported from the higher part to the lower part through the medium support unit 40 from the sheet feeding unit 13 is configured of a transport path (bending path W) in which the path is changed to a transport direction F in the horizontal direction toward the medium clamping unit 17 from the vicinity, or the like, of the relay roller 51. In addition, the relay roller 51, or the like, takes a role of a regulation unit which regulates so that the sheet RP which is transported does not enter the inside of the bending path W more than necessary in the bending path W. The sheet RP is slackened on the bending path W; however, it is preferable to adjust a slackening amount of the sheet RP to an extent of not being in contact with the relay roller 51, or the like. In this manner, it is possible to reduce an influence on transporting which is caused when the sheet RP comes into contact with the relay roller 51, or the like. In addition, since configurations of the medium clamping unit 17 and the medium support unit 40 are the same as those in the first embodiment, descriptions thereof will be omitted.

In the transport unit 2*a* according to the embodiment, the sheet feeding unit 13 is arranged at the most upstream side in the transport direction F, the medium support unit 40 is arranged on the downstream side of the sheet feeding unit 13 in the transport direction F, and the medium clamping unit 17 is arranged on the downstream side of the medium support unit 40 in the transport direction F. Here, in the bending path W between the medium clamping unit 17 and the medium support unit 40, the sheet RP is slackened, and a slackening amount detection unit 60 which detects a slackening amount of the sheet RP is included. In detail, the sheet RP is slackened in a point that the sheet RP is nipped (clamped) between the sheet sending roller 17*a* and the sheet pressing roller 17*b* in the medium clamping unit 17, and a point that the sheet RP is nipped (clamped) between the first roller 40*a* and the second roller 40*b* in the medium support unit 40. In addition, the slackening amount detection unit 60 is arranged in the bending path W. In addition, the slackening amount detection unit 60 is arranged inside the bending path W. Specifically, the slackening amount detection unit is arranged between the transport path of the sheet RP (bending path W) and the recording unit 15. In this manner, it is possible to effectively use a space in the inside of the bending path W, and to miniaturize a configuration of the recording apparatus 1*a*.

FIGS. 5A and 5B illustrate a configuration of the slackening amount detection unit, in which FIG. 5A is a schematic side view of the slackening amount detection unit, and FIG. 5B is a schematic plan view which illustrates an arranging position of the slackening amount detection unit. As illustrated in FIG. 5A, the slackening amount detection unit 60 includes a detection lever unit 61, a fulcrum portion 62 which is provided at one end portion of the detection lever unit 61, a detection unit 63 which is provided at the other end portion of the detection lever unit 61, and a detection sensor 67 (for example, photo sensor) which is arranged at a position facing the detection unit 63. The detection lever unit 61 is configured so as to rotate around the fulcrum portion 62. In addition, the slackening amount detection unit 60 according to the embodiment detects a slackening amount by being in contact with the sheet RP. In this manner, it is possible to accurately detect a slackening amount without depending on reflectance, or the like, of the sheet RP which is transported compared to a detection unit which performs optical detection using a noncontact method. For this reason, it is possible to detect a slackening amount without being influenced by a type of the sheet RP such as a sheet RP of a transparent material, or roughness of the surface of a sheet RP, and to correspond to sheets RP of various types. Specifically, a contact roller 66 which is in contact with a sheet RP, and is rotatable is provided at a part of the detection lever unit 61. In addition, it is configured so that the detection lever unit 61 rotatably moves around the fulcrum portion 62 due to a change in slackening amount of the sheet RP in the bending path W. In addition, a tension spring 69 is connected to the detection lever unit 61, and the tension spring urges the detection lever unit 61 to an extent of not applying a load to the sheet RP.

In addition, for example, when a slackening amount of the sheet RP in the bending path W is reduced, as denoted by a dashed line in FIG. 5A, the sheet RP is pushed upward. Along with this, the contact roller 66 which comes into contact with the sheet RP is pushed upward. Then, the detection lever unit 61 rotates on the detection sensor 67 side around the fulcrum portion 62. In addition, it is configured so that, when a distance between the detection unit 63 and the detection sensor 67 becomes short, and an output value from the detection sensor 67 exceeds a predetermined threshold value, a switch of the detection sensor 67 is turned on. In addition, as illustrated in FIG. 5B, a plurality of the slackening amount detection unit 60 are arranged in the width direction of the sheet RP. In addition, it is configured so that it is possible to detect a slackening amount in any portion of the sheet RP in the width direction. In addition, it is possible to detect a slackening amount when the slackening amount detection unit 60 is arranged at least one portion of the sheet RP in the width direction. When the slackening amount detection unit is arranged at only one portion, it is preferable to be a position at which a slackening amount in a minimum width can be detected in a corresponding sheet RP.

Meanwhile, it is configured so that a predetermined tension is applied to a sheet RP between the sheet feeding unit 13 (roll body) and the medium support unit 40. In detail, tension is applied to the sheet RP in a point that the sheet RP is pulled out from the sheet feeding unit 13 (roll body), and a point that the sheet RP is nipped (clamped) between the first roller 40*a* and the second roller 40*b* in the medium support unit 40. In addition, it is configured so that a transport amount of the sheet RP is adjusted so that a predetermined tension is applied to the sheet RP. Accordingly, the recording apparatus 1*a* according to the embodiment includes a region in which tension is applied to the sheet RP between the sheet feeding unit 13 (roll body) and the medium support unit 40, and a region in which tension is not applied to the sheet RP between the medium support unit 40 and the medium clamping unit 17 in the transport unit 2*a*. In addition, the sheet RP is transported to the recording unit 15 side in a state of not being applied with tension.

Subsequently, a configuration of the control unit of the recording apparatus will be described. FIG. 6 is a block diagram which illustrates a configuration of the control unit of the recording apparatus. As illustrated in FIG. 6, a control unit 100 includes a commanding unit 130, a driving unit 140, a display driving unit 150, and an input detection unit 160. In addition, the configuration of the control unit 100 is the same as that in the first embodiment, descriptions thereof is omitted, and different portions will be described. Specifically, the commanding unit 130 of the control unit 100 is connected with an input detection unit 160 through the input-output interface 131. In addition, the slackening amount detection unit 60 is connected to the input detection unit 160. In this manner, a detection result of a slackening amount using the slackening amount detection unit 60 is input to the control unit 100. In addition, it is possible to control (adjust) a slackening amount of the sheet RP between the medium clamping unit 17 and the medium support unit 40 by performing a driving control of the second motor based on the detection result of the slackening amount using the slackening amount detection unit 60.

Subsequently, a control method of the recording apparatus will be described based on the second embodiment. FIG. 7 is a flowchart which illustrates the control method of the recording apparatus. In addition, according to the embodiment, a control method in a case in which a slackening amount of a sheet RP which is transported is reduced in the bending path W of the sheet RP between the medium clamping unit 17 and the medium support unit 40 will be described.

First, in step S11, the transport unit 2*a* is driven. Specifically, the first motor (roll axis 13*a*), the second motor (first roller 40*a*), the third motor (sheet sending roller 17*a*), and the like, are driven based on a driving program. In this manner, a sheet RP is pulled out from the roll body of the sheet feeding unit 13, and is transported to along the transport direction F. In addition, the sheet RP is slackened in the bending path W of the sheet RP between the medium clamping unit 17 and the medium support unit 40, and the first motor, the second motor, and the third motor are subjected to driving controls so that a predetermined tension is applied to the sheet RP between the roll body of the sheet feeding unit 13 and the medium support unit 40.

In addition, the slackening amount detection unit 60 is set to a state in which the slackening amount detection unit can detect a slackening amount by supplying power, or by performing setting as necessary. A driving timing in which the slackening amount can be detected may be earlier than driving of the transport unit 2*a* in step S11, or may be the same timing as the driving timing of the transport unit 2*a*.

Subsequently, in step S12, it is determined whether or not the switch of the slackening amount detection unit 60 is turned on. Here, a state in which the switch of the slackening amount detection unit 60 is not turned on (OFF state) is a state in which a distance between the detection unit 63 and the detection sensor 67 in the slackening amount detection unit 60 is a constant distance or more, and an output value from the detection sensor 67 does not exceed a predetermined threshold value. That is, it is a state in which the detection sensor 67 is not capable of detecting the detection unit 63, and the sheet RP is slackened in the bending path W of the sheet RP between the medium clamping unit 17 and the medium support unit 40. On the other hand, a state in which the switch of the slackening amount detection unit 60 is turned on is a state in which the distance between the detection unit 63 and the detection sensor 67 in the slackening amount detection unit 60 becomes short, and the output value from the detection sensor 67 exceeds the predetermined threshold value. That is, it is a state in which the detection sensor 67 detects the detection unit 63, and the slackening amount of the sheet RP is reduced compared to the predetermined slackening amount in the bending path W of the sheet RP between the medium clamping unit 17 and the medium support unit 40. When tension is applied to the sheet RP to some extent, it is a state in which tension increases, and exceeds the predetermined tension threshold value. In addition, when the switch of the slackening amount detection unit 60 is not turned on (OFF state) (No in step S12), driving controls of the first motor, the second motor, and the third motor are finished, and when the switch of the slackening amount detection unit 60 is turned on (Yes in step S12), the process proceeds to step S13.

In addition, when the process proceeds to step S13, the second motor which is connected to the first roller 40*a* of the medium support unit 40 is subjected to a driving control. Specifically, the second motor is subjected to a driving control so that a transport amount (sending amount) of the sheet RP using the medium support unit 40 becomes larger than a transport amount (sending amount) of the sheet RP using the medium clamping unit 17. In this manner, when tension of a certain degree is applied to the sheet RP by slackening the sheet RP in the bending path W of the sheet RP between the medium clamping unit 17 and the medium support unit 40, it is possible to lower tension with respect to the sheet RP which is transported.

Subsequently, the process returns to step S12, and whether or not the switch of the slackening amount detection unit 60 is turned on is determined. In addition, a process in step S13 is executed until a state in which the switch of the slackening amount detection unit 60 is not turned on, and when it is a state in which the switch of the slackening amount detection unit 60 is not turned on, driving controls of the first motor, the second motor, and the third motor are finished. In addition, after the state in which the switch of the slackening amount detection unit 60 is not turned on, the driving control of the second motor which is connected to the first roller 40*a* of the medium support unit 40 may be continued for a while, and a transport amount of the sheet RP may be increased. In this case, it is preferable to set a degree in which the sheet RP is not in contact with various members which are arranged along the transport path. That is, the second motor may be subjected to a driving control so that the sheet RP is not in contact with members, or the like, which are arranged on the lower side, or the like, of the transport path of the sheet RP by being excessively slackened.

As described above, according to the embodiment, it is possible to obtain the following effects.

(1) The sheet RP which is transported to the recording unit 15 from the roll body of the sheet feeding unit 13 is transported through the bending path W which is formed between the medium support unit 40 and the medium clamping unit 17. Accordingly, the transport path between the roll body of the sheet feeding unit 13 and the recording unit 15 become short compared to a transport path of the sheet RP which is linearly formed, and it is possible to miniaturize the configuration of the recording apparatus 1*a*.

(2) It is possible to detect a slackening amount of the sheet RP in the bending path W which is formed between the medium support unit 40 and the medium clamping unit 17 using the slackening amount detection unit 60. In this manner, it is possible to detect an appropriate slackening amount with respect to the sheet RP. In addition, it is possible to apply an appropriate slackening amount with respect to the sheet RP in the bending path W by performing a driving control of the second motor based on a detection result of the slackening amount detection unit 60. In addition, since tension is hardly applied to the sheet RP by adopting a configuration in which tension is applied to the sheet RP between the sheet feeding unit 13 and the medium support unit 40, and on the other hand, the sheet RP is slackened between the medium support unit 40 and the medium clamping unit 17, even when the first roller 40*a* of the medium support unit 40 performs an eccentric rotation, or there is a difference in a transport amount of the medium of the medium support unit 40 between one end side and the other end side of the sheet RP in the width direction, an influence caused by a fluctuation in a transport amount of the medium does not become strong in the recording unit 15. That is, a fluctuation in a transport amount when the sheet RP is transported, or a difference in a transport amount of the sheet RP in the width direction is easily reduced. Accordingly, the fluctuation in a transport amount of the sheet RP or meandering of the sheet RP is avoided before the sheet RP reaches the recording unit 15, and it is possible to perform high quality recording on the sheet RP in the recording unit 15.

In addition, the invention is not limited to the above described embodiments, and it is possible to add various modifications or improvements to the embodiments. Modification examples will be described below.

Modification Example 1

In the first and second embodiments, the configuration in which the long sheet-shaped sheet RP is applied as a medium is described; however, it is not limited to the configuration. For example, it may be a configuration in which a cut sheet is transported. FIG. 8 is a schematic diagram which illustrates a configuration of a recording apparatus according to the modification example. As illustrated in FIG. 8, in a recording apparatus 1*b*, a cut sheet P is input instead of the sheet feeding unit 13 as a roll body. At this time, it is set so that a tip end portion of the cut sheet P in the transport direction F touches the first roller 40*a* and the second roller 40*b* of the medium support unit 40. In addition, the cut sheet is transported to the medium clamping unit 17 side by driving the medium support unit 40. In addition, since a basic configuration of the recording apparatus 1*b* is the same as that of the recording apparatus 1 in the first embodiment, descriptions thereof will be omitted. Also in such a configuration, it is possible to reduce meandering of the cut sheet P by being transported in the transport direction F through the medium support unit 40. In addition, in the recording apparatus 1*b*, the medium support unit 40 is arranged at the higher part of the main body case 12. By doing so, it is possible to easily set the cut sheet P. In addition, in the recording apparatus 1*b*, it is possible to apply a cut sheet P with a size which can be clamped in the medium support unit 40 and the medium clamping unit 17 at the same time.

Modification Example 2

The first and second embodiments have configurations in which the medium support unit 40 configured of the first roller 40*a* and the second roller 40*b* is included, and the sheet RP is supported using the medium support unit 40; however, it is not limited to the configuration. For example, it may be a configuration of a recording apparatus which performs recording by transporting a medium which is pulled out from a roll body around which the medium is wound in a roll shape, includes a recording unit, and a medium support roller, and transports the medium by causing the medium to go along the peripheral face of the medium support roller.

FIG. 9 is a schematic diagram which illustrates a configuration of a recording apparatus according to the modification example. As illustrated in FIG. 9, a recording apparatus 1*c* is configured of a main body case 12, a transport unit 2*b* which transports a medium, and the like. In addition, since a configuration of the main body case 12, and a sheet feeding unit 13, a recording unit 15, a sheet discharging unit 14, and the like, which are arranged in the main body case 12 is the same as the configuration in the first embodiment, descriptions thereof will be omitted.

Subsequently, a configuration of the transport unit 2*b* will be described in detail. The transport unit 2*b* according to the modification example includes the sheet feeding unit 13, a medium clamping unit 17 which is provided on the side further upstream than the recording unit 15 in a transport direction F, and clamps the sheet RP, a medium support roller 400 which is provided on the side further upstream than the medium clamping unit 17 in the transport direction F, and supports a sheet RP, and the like. In addition, since a configuration of the medium clamping unit 17 is the same as that in the first embodiment, descriptions thereof will be omitted.

The medium support roller 400 is a roller which transports the sheet RP while supporting the sheet. Specifically, the medium support roller is configured so as to support the sheet RP using a peripheral face 400*a* of the medium support roller 400 which is in a surface state on which the sheet RP hardly slips using a strong friction force, or the like, and transport the sheet RP along the peripheral face 400*a*.

In addition, an auxiliary roller 450 for pressing the sheet RP against the medium support roller 400 is arranged at least one of the upstream side and the downstream side of the sheet RP in the transport direction F of the medium support roller 400. In addition, according to the modification example, one auxiliary roller 450 (450*a*, 450*b*) is arranged on the respective upstream side and downstream side of the sheet RP in the transport direction F of the medium support roller 400. In addition, it is configured so that the sheet RP can be clamped between the medium support roller 400 and the auxiliary roller 450. Specifically, as illustrated in FIG. 9, the medium support roller 400 and the auxiliary roller 450*a* are arranged so that a bending region H1 which is bent in the transport path of the sheet RP transported between the auxiliary roller 450*a* arranged on the upstream side in the transport direction F of the sheet RP of the medium support roller 400 and the medium support roller 400 is formed. Similarly, the medium support roller 400 and the auxiliary roller 450*b* are arranged so that a bending region H2 which is bent in the transport path of the sheet RP transported between the auxiliary roller 450*b* arranged on the downstream side in the transport direction F of the sheet RP of the medium support roller 400 and the medium support roller 400 is formed. In addition, a bending region H3 in which the transport path in which the sheet RP is transported along the peripheral face 400*a* of the medium support roller 400 is also bent is formed. In this manner, it is possible to reduce an error in a transport amount in the width direction of the sheet RP in each bending region H1, H2, and H3, and to improve the straightness with respect to the transport direction F, since quantity of friction due to a contact between the sheet RP and the medium support roller 400 or the auxiliary rollers 450*a* and 450*b* increases when the sheet RP is transported through the bending regions H1, H2, and H3.

In addition, it is configured so that a relative position between the medium support roller 400 and the auxiliary rollers 450*a* and 450*b* can be moved. According to the modification example, the auxiliary rollers 450*a* and 450*b* are configured so as to move with respect to the medium support roller 400. Specifically, the auxiliary rollers 450*a* and 450*b* are connected to a movable unit 460, the movable unit 460 is connected to a driving source (motor), and the auxiliary rollers can move in a direction S corresponding to the medium support roller 400 due to driving of the driving source (motor). Accordingly, it is possible to arbitrarily set a relative position between the medium support roller 400 and the auxiliary rollers 450*a* and 450*b*. In this manner, it is possible to set an appropriate transport path with respect to the sheet RP which is transported by arbitrarily changing a bending shape of the bending region H of the transport path of the sheet RP. In addition, by changing a relative position between the medium support roller 400 and the auxiliary rollers 450*a* and 450*b*, it is possible to change a contact amount between the sheet RP and the peripheral face 400*a* of the medium support roller 400, to adjust the quantity of friction, and to adjust a holding force of the sheet RP on the peripheral face 400*a* of the medium support roller 400.

In addition, it is configured so that a diameter of the auxiliary roller 450 is smaller than a diameter of the medium support roller 400. In this manner, it is possible to save space. In addition, according to the modification example, the sheet RP is transported by driving the medium support roller 400. Specifically, it is configured so that the medium support roller 400 is connected to a driving source (motor), and the medium support roller is rotated due to driving of the driving source (motor). In this manner, the sheet RP can be clamped using the medium support roller 400 and the auxiliary roller 450, and is transported to the medium clamping unit 17 side which is located on the downstream side in the transport direction F following the peripheral face 400*a* of the medium support roller 400 and the peripheral face of the auxiliary roller 450. Accordingly, the auxiliary roller 450 according to the modification example is not a roller which is driven along with a rotation of the medium support roller 400. That is, the sheet RP is not nipped using the medium support roller 400 and the auxiliary roller 450. In detail, the auxiliary roller 450 is a roller which rotates when the sheet RP moves in the transport direction F due to friction between the peripheral face 400*a* of the medium support roller 400 and the sheet RP.

In addition, the transport path between the medium clamping unit 17 and the medium support roller 400 is configured so as to be a bending transport path. Specifically, the relay rollers 51 and 52 which relay transporting of the sheet RP, and are located on the way of the transport path are arranged between the medium clamping unit 17 and the medium support roller 400, and the sheet RP is transported through the vicinity of the relay rollers 51 and 52. In this manner, the transport direction F of the sheet RP which is transported from the higher part to the lower part through the medium support roller 400 from the sheet feeding unit 13 is changed to a transport direction F in the horizontal direction toward the medium clamping unit 17 from the vicinity of the relay rollers 51 and 52. In addition, similarly to those in the first and second embodiments, the relay rollers 51 and 52 take a role of a regulation unit which regulates so that the sheet RP which is transported does not enter the inside of the bending path more than necessary in the bending path. The sheet RP is slackened on the bending path; however, it is preferable to adjust a slackening amount of the sheet RP to an extent of not being in contact with the relay rollers 51 and 52. In this manner, it is possible to reduce an influence on transporting which is caused when the sheet RP comes into contact with the relay rollers 51 and 52. In addition, since the sheet RP is transported from the higher part to the lower part through the bending path between the medium clamping unit 17 and the medium support roller 400, it is possible to transport the sheet RP in a state of being floated, and to cause the sheet not to come into contact with members which are arranged on the lower side of the transport path, or the support unit of the sheet RP when being transported. For this reason, it is also possible to reduce an influence on transporting which is caused when the sheet RP comes into contact with various members on the side further downstream than the medium support roller 400 in the transport direction F, not only an influence which is caused when tension is applied to the sheet RP on the side further upstream than the medium support roller 400 in the transport direction F.

In addition, in the modification example, it is possible to adjust a slackening amount of the sheet RP between the medium clamping unit 17 and the medium support roller 400 by performing a driving control of the medium support roller 400. In this manner, it is possible to transport the sheet RP while slackening the sheet between the medium clamping unit 17 and the medium support roller 400. Accordingly, it is possible to easily reduce a difference in a transport amount of the sheet RP in the width direction since tension is not applied to the sheet RP between the medium clamping unit 17 and the medium support roller 400.

Subsequently, a configuration of the control unit of the recording apparatus will be described. FIG. 10 is a block diagram which illustrates the configuration of the control unit of the recording apparatus. As illustrated in FIG. 10, the control unit 100 includes a commanding unit 130, a driving unit 140, a display driving unit 150, and an input detection unit 160. In addition, the configuration of the control unit 100 is the same as that in the first embodiment, descriptions thereof is omitted, and different portions will be described. Specifically, a second motor driving unit 144 of the driving unit 140 controls driving of the second motor which is connected to the medium support roller 400. In addition, a sixth motor driving unit 148 controls driving of the sixth motor which is connected to the movable unit 460.

In addition, due to such a configuration of the control unit 100, it is possible to control various units. For example, by performing driving controls of the first motor which is connected to the sheet feeding unit 13, the second motor which is connected to the medium support roller 400, and the third motor which is connected to the sheet sending roller 17*a*, it is possible to transport the sheet RP in the transport direction F by pulling out the sheet RP from the sheet feeding unit 13 (roll body). In this case, it is controlled so that a sending amount of the sheet RP which is transported in the transport direction F using the medium support roller 400 is larger than a sending amount of the sheet RP which is transported in the transport direction F using the sheet sending roller 17*a* of the medium clamping unit 17. In addition, by performing a driving control of the sixth motor which is connected to the movable unit 460, the auxiliary rollers 450*a* and 450*b* are controlled so as to move in the direction S which goes toward the medium support roller 400. In this manner, it is possible to arbitrarily change a clamping force with respect to the sheet RP using the medium support roller 400 and the auxiliary roller 450. In addition, it is possible to arbitrarily set the bending region H (H1, H2, H3) which is formed by the auxiliary rollers 450*a* and 450*b*, and the medium support roller 400. That is, it is possible to control a winding amount of the sheet RP in the medium support roller 400.

As described above, according to the modification example, it is possible to obtain the following effects.

The sheet RP is transported along the peripheral face 400*a* of the medium support roller 400 while being pressed against the medium support roller 400 using the auxiliary roller 450. In this manner, the sheet RP is transported while being wound around the medium support roller 400, and due to friction between the medium support roller 400 and the sheet RP at this time, a difference in a transport amount of the sheet RP in the width direction is reduced. In addition, since the sheet RP is transported without being clamped in the transport unit 2*b*, it is possible to suppress an occurrence of indentation, or the like, on the sheet RP.

Modification Example 3

In the modification example 2, the auxiliary roller 450 for pressing the sheet RP against the medium support roller 400 is arranged; however, it is not limited to the configuration. For example, it may be a configuration in which the auxiliary roller 450 is omitted. FIG. 11 is a schematic diagram which illustrates a configuration of a recording apparatus according to the modification example. As illustrated in FIG. 11, a recording apparatus 1*d* includes a main body case 12, a transport unit 2*c*, or the like. Specifically, the recording apparatus 1*d* includes a roll body (sheet feeding unit 13) around which a sheet RP is wound in a roll shape, a recording unit 15, and a medium support roller 400, and has a configuration in which the sheet RP is transported along a peripheral face 400*a* of the medium support roller 400. In addition, the sheet feeding unit 13 is arranged at the lower part of the recording apparatus 1*d*, and the sheet RP which is pulled out from the roll body of the sheet feeding unit 13 is transported toward a medium clamping unit 17 which is arranged at the lower part of the medium support roller 400 through the medium support roller 400 which is arranged at the higher part of the sheet feeding unit 13. That is, a bending region H which is bent on the peripheral face 400*a* of the medium support roller 400 is formed in the transport path of the sheet RP. In addition, the sheet RP is transported through the bending region H. Since the sheet RP is wound using the medium support roller 400 by bending the transport path, a difference in a transport amount in the width direction of the sheet RP is reduced, and it is possible to improve the straightness when transporting the sheet RP. In this manner, similarly to effects in the above described embodiments, it is possible to suppress an occurrence of indentation, or the like, of the sheet RP at a time of transporting. In addition, it is possible to adjust a slackening amount of the sheet RP between the medium clamping unit 17 and the medium support roller 400 by performing a driving control of the medium support roller 400. In this manner, as illustrated in FIG. 11, it is possible to transport the sheet RP while slackening the sheet between the medium clamping unit 17 and the medium support roller 400. In this manner, since tension is not applied to the sheet RP between the medium clamping unit 17 and the medium support roller 400, it is possible to easily reduce a difference in transport of the sheet RP in the width direction.

Modification Example 4

The medium support unit 40 according to the first and second embodiments is configured of the first roller 40*a* and the second roller 40*b*; however, it is not limited to the configuration. For example, the medium support unit 40 may be a wheel, or the like. In this case, for example, the sheet RP is transported through a wheel. Since the sheet RP is supported (wound) by a wheel, it is possible to improve the straightness of the sheet RP in the transport direction F.

Modification Example 5

The slackening amount detection unit 60 according to the second embodiment is set to a contact-type detection unit which performs detection by being in contact with the sheet RP which is transported; however, it is not limited to the configuration. For example, it may be a configuration of detecting a slackening amount in a noncontact method. By doing so, it is possible to suppress a scratch, dirt, or the like, which can be attached due to contact without applying an unnecessary load to the sheet RP.

REFERENCES SIGNS LIST

1, 1*a*, 1*b*, 1*c*, 1*d* Recording apparatus
2, 2*a*, 2*b*, 2*c* Transport unit
12 Main body case
13 Sheet feeding unit
13*a* Roll axis
15 Recording unit
17 Medium clamping unit
17*a* Sheet sending roller
17*b* Sheet pressing roller
18 Carriage
19 Liquid ejecting head
20 Platen
40 Medium support unit
40*a* First roller
40*b* Second roller
41 Eccentric cam
41*a* Eccentric axis
51, 52 Relay roller
60 Slackening amount detection unit
66 Contact roller
100 Control unit
400 Medium support roller
400*a* Peripheral face
450, 450*a*, 450*b* Auxiliary roller
460 Movable unit
W Bending path

The invention claimed is:

1. A recording apparatus which transports a medium, and performs recording with respect to the transported medium, the apparatus comprising:

a recording unit;

a medium clamping unit which is provided on a side further upstream than the recording unit in a transport direction from the medium clamping unit to the recording unit, and clamps the medium therebetween;

a medium support unit which is provided on a side further upstream than the medium clamping unit in the transport direction, and supports the medium, the medium support unit being higher than the medium clamping unit in an antigravity direction; and a regulation unit configured such that entry of the medium to an inside of a bending path is minimized and such that the medium is slackened in a gravity direction between the medium support unit and the medium clamping unit in the transport direction, wherein the medium is slackened along the bending path between the medium clamping unit and the medium support unit.

2. The recording apparatus according to claim 1, wherein the medium is pulled out from a roll body which is wound up in a roll shape, and wherein a transport amount of the medium is adjusted so that a predetermined tension is applied to the medium between the roll body and the medium support unit.

3. The recording apparatus according to claim 1, wherein the bending path is provided between the medium clamping unit and the medium support unit.

4. The recording apparatus according to claim 1, wherein a slackening amount of the medium between the medium clamping unit and the medium support unit is adjusted by driving the medium support unit.

5. The recording apparatus according to claim 1, wherein the medium support unit is configured so as to clamp the medium therebetween, and a clamping force of the medium support unit can be changed.

6. A recording apparatus which transports a medium from a roll, and performs recording on a first surface of the medium, the first surface is an outside surface of the roll, the apparatus comprising;

a recording unit, a medium clamping unit configured to clamp the medium, the medium clamping unit being on a side further upstream than the recording unit in a transport direction from the roll to the recording unit;

a medium support unit configured to support the medium, the medium support unit being on a side further upstream than the medium clamping unit in the transport direction, wherein the medium support unit is higher than the medium clamping unit in an antigravity direction; and a regulation unit configured such that the medium is slackened so that the first surface of the medium is an inner surface of a curve, and such that the medium is slackened in a gravity direction between the medium support unit and the medium clamping unit in the transport direction.

* * * * *